US010287820B2

(12) United States Patent
Huehn

(10) Patent No.: US 10,287,820 B2
(45) Date of Patent: May 14, 2019

(54) FALL PROTECTION DEVICE FOR A RESCUE CAGE OF AN AERIAL LADDER, IN PARTICULAR FOR FIREFIGHTING VEHICLES

(71) Applicant: IVECO MAGIRUS AG, Ulm (DE)

(72) Inventor: Alexander Huehn, Ulm (DE)

(73) Assignee: IVECO MAGIRUS AG, Ulm (DE)

( * ) Notice: Subject to any disclaimer, the term of this patent is extended or adjusted under 35 U.S.C. 154(b) by 59 days.

(21) Appl. No.: 15/162,173

(22) Filed: May 23, 2016

(65) Prior Publication Data

US 2016/0348432 A1 Dec. 1, 2016

(30) Foreign Application Priority Data

May 27, 2015 (EP) ..... 15169503

(51) Int. Cl.
*E06C 5/36* (2006.01)
*A62B 35/00* (2006.01)
*A62C 27/00* (2006.01)

(52) U.S. Cl.
CPC ..... *E06C 5/36* (2013.01); *A62B 35/0043* (2013.01); *A62B 35/0093* (2013.01); *A62C 27/00* (2013.01)

(58) Field of Classification Search
CPC .... E06C 5/36; A62B 35/0043; A62B 35/0093
See application file for complete search history.

(56) References Cited

U.S. PATENT DOCUMENTS 4,458,781 A 7/1984 Ellis et al.
7,275,710 B2 * 10/2007 VanDruff ..... B64D 25/06 182/231
8,413,764 B1 * 4/2013 Cohen ..... E06C 7/18 182/62.5
2010/0122874 A1 * 5/2010 Harris, Jr. ..... A62B 1/14 182/231
2010/0130108 A1 * 5/2010 Mann ..... E04G 3/30 451/75

(Continued)

FOREIGN PATENT DOCUMENTS

CA 2849115 A1 * 5/2013 ..... A62B 1/10
CA 2849115 A1 * 5/2013 ..... A62B 1/10

(Continued)

OTHER PUBLICATIONS

European Search Report for European Application No. 15169503.8, dated Aug. 24, 2015, 7 pages.

*Primary Examiner* — Katherine W Mitchell
*Assistant Examiner* — Candace L Bradford
(74) *Attorney, Agent, or Firm* — Stetina Brunda Garred and Brucker

(57) ABSTRACT

Fall protection device for a rescue cage of an aerial ladder, in particular for firefighting vehicles, comprising a retractable fall protection device having a body with a first and a second end, opposite to said first side, wherein said first side is individuated by an opening through which a relative self retractable safety belt slides, deflecting means arranged in front of said first side and spaced apart from said first side, supporting means comprising a joint connected to said second side of the body and supporting said deflecting means so as to be in front of said first side and spaced apart from said first side.

7 Claims, 5 Drawing Sheets

(56) References Cited

U.S. PATENT DOCUMENTS

| | | | | |
|---|---|---|---|---|
| 2011/0078864 | A1* | 4/2011 | Bennett | B65G 69/22 14/71.7 |
| 2013/0299275 | A1* | 11/2013 | Westermann | A62B 35/0093 182/3 |
| 2014/0048353 | A1* | 2/2014 | Ellis | A62B 35/005 182/241 |
| 2015/0027808 | A1 | 1/2015 | Baillargeon et al. | |
| 2015/0273255 | A1* | 10/2015 | Lenz, Jr. | E06C 5/04 280/4 |

FOREIGN PATENT DOCUMENTS

| | | | | |
|---|---|---|---|---|
| CA | 2930998 | A1 * | 11/2016 | A62B 35/0093 |
| CA | 2930998 | A1 * | 11/2016 | A62B 35/0093 |
| GB | 2353557 | | 2/2001 | |

* cited by examiner

FALL PROTECTION DEVICE FOR A RESCUE CAGE OF AN AERIAL LADDER, IN PARTICULAR FOR FIREFIGHTING VEHICLES

CROSS-REFERENCE TO RELATED APPLICATIONS

The present application claims priority to European Patent Application No. 15169503.8 filed May 27, 2015, the entirety of the disclosure of which is expressly incorporated herein by reference.

STATEMENT RE: FEDERALLY SPONSORED RESEARCH/DEVELOPMENT

Not Applicable

BACKGROUND

The present invention relates to fall protections for rescue cages of an aerial ladder, in particular for firefighting vehicles Working in an cage on the tip of an aerial ladder, and in particular a rescue cage, often requires leaning out of the cage, and in other cases could also require to maintain the doors open. In addition, the cage might crash against an obstacle with resulting heavy rebound.

All these situations might cause a person in the cage to be thrown out of it.

To prevent the risk of falling, self belay systems can be used. For example, the operators can be provided with a safety harness connected through ropes to the cage.

The ropes are not extensible so they limit the operator movements.

Retractable fall arresters are known. A retractable fall arrester consists of a self winding spool on which a safety belt is wound. The safety belt can be unrolled to a predetermined speed, beyond such a predetermined speed, the spool locks the safety belt.

They are designed to be hung up, for example to a horizontal arm, while the safety belt is pulled downward. Different usages are not permissible due to the fact that the retractable fall arrester cannot bear strengths different from those derived from said downward pulling.

In addition, belaying with standard retractable fall arrester stored in the rescue cage would require a safe place to store the fall arrester, and on the other hand enough clearance to make sure there are no lateral forces on the retractable fall arrester at any orientation while used. Moreover, time consuming actions would be necessary to get the fall arrester out of the storage and ready to use.

BRIEF SUMMARY

Main object of the present invention is to provide a fall protection system that can be implemented in any circumstance, namely with any orientation, so as to be easily installed in a rescue cage of an aerial ladder, in particular for firefighting vehicles, so as to simplify the operator or firefighter operations, being constantly ready to be used.

A retractable fall arrester has a body having two opposite sides, one first side having an opening through which the safety belt slides out or is retracted to be wound.

The basic idea of the present invention is that deflecting means are arranged in front of said first side to drive the safety belt so as to transmit only a pure pulling strength to a retractable fall arrester while the second side of the retractable fall arrester body, opposite to that first side, is supported by a joint, so strengths different from pure pulling are unloaded on the deflecting means and the body of the retractable fall arrester can autonomously orient itself in order to minimize strength components different from pure pulling strengths. According to the present invention, independently from the direction of the strengths pulling the safety belt, the retractable fall arrester is subject only to a pure pulling strength in agreement to the constructional features of the known retractable fall protection.

Furthermore, the combination of the deflecting means and of the joint permit to limit the oscillations of the body of the retractable fall arrester is irrespective of the direction of pulling of the self winding safety belt.

Preferably the free accessible end of the safety belt has a stopping means, that could coincide with a carabiner, so that the safety belt cannot be wound completely, by maintaining the retractable fall arrester body constantly under traction between the joint and the safety belt in cooperation with the deflecting means.

Advantageously, thanks to the present invention, the per se known retractable fall arrester can be installed in a cage in any position and according to any space orientation.

According to a preferred embodiment of the invention the hinge and the deflecting means are independently supported by a cage frame.

According to another preferred embodiment of the invention the hinge and the deflecting means are supported by a common support element, independent from the cage frame, that can be associated to the tip of an aerial ladder and/or to a cage.

Preferably, a protection cover is associated to the support element in order to protect the retractable fall arrester by mechanical or chemical agents.

Thanks to the present invention, the heavy weight of the retractable fall arrester is borne by the cage, or by a fixed point to which the operators are designed to be belayed. The operator or fire-fighter has only to pool the freely accessible end of the safety belt and connect it, for example by means of a carabiner, to his own safety harness.

Another subject of the present invention is a rescue cage provided with an anti-fall protection according to the present invention.

A further object of the present invention is a method to install a retractable fall arrester according to the present invention.

Preferably, the anti-fall protection is integrated in the floor and/or a wall of the rescue cage, by presenting a carabiner, connected to the free end of the safety belt, supported by a top edge of a railing of the rescue cage, ready to be pulled and connected to his/her own safety harness.

These and further objects are achieved by means of the attached claims, which describe preferred embodiment of the invention, forming an integral part of the present description.

BRIEF DESCRIPTION OF THE DRAWINGS

The invention will become fully clear from the following detailed description, given by way of a mere exemplifying and non limiting example, to be read with reference to the attached drawing figures, wherein.

The same reference numerals and letters in the figures designate the same or functionally equivalent parts.

According to the present invention, the term "second element" does not imply the presence of a "first element", first, second, etc. are only used for improving the clarity of the description and they should not be interpreted in a limiting way.

DETAILED DESCRIPTION

Figure 1:
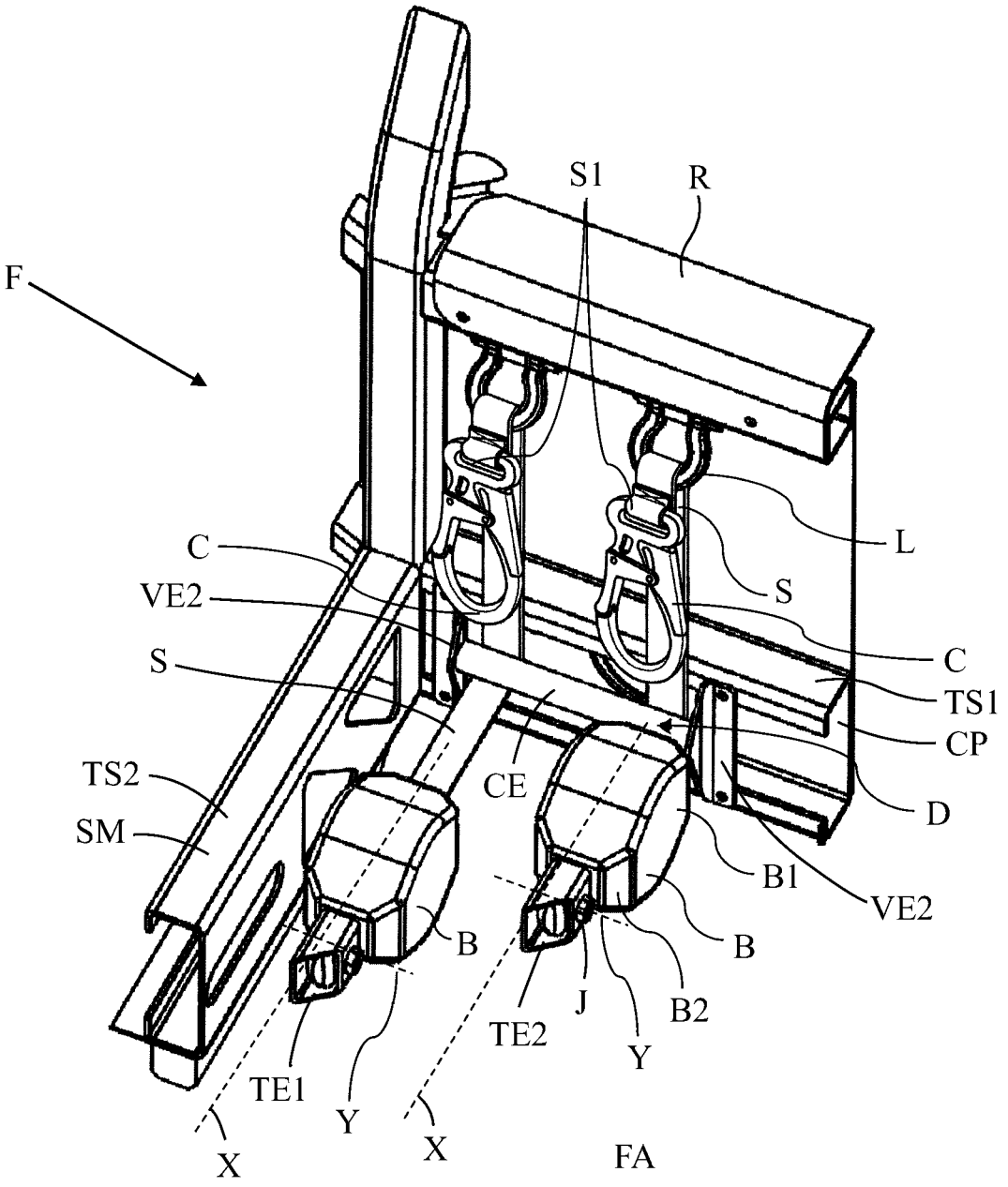
FIG. 1 shows a first perspective view of a retractable fall arrester provided of means according to a first embodiment of the present invention.
Figure 2:
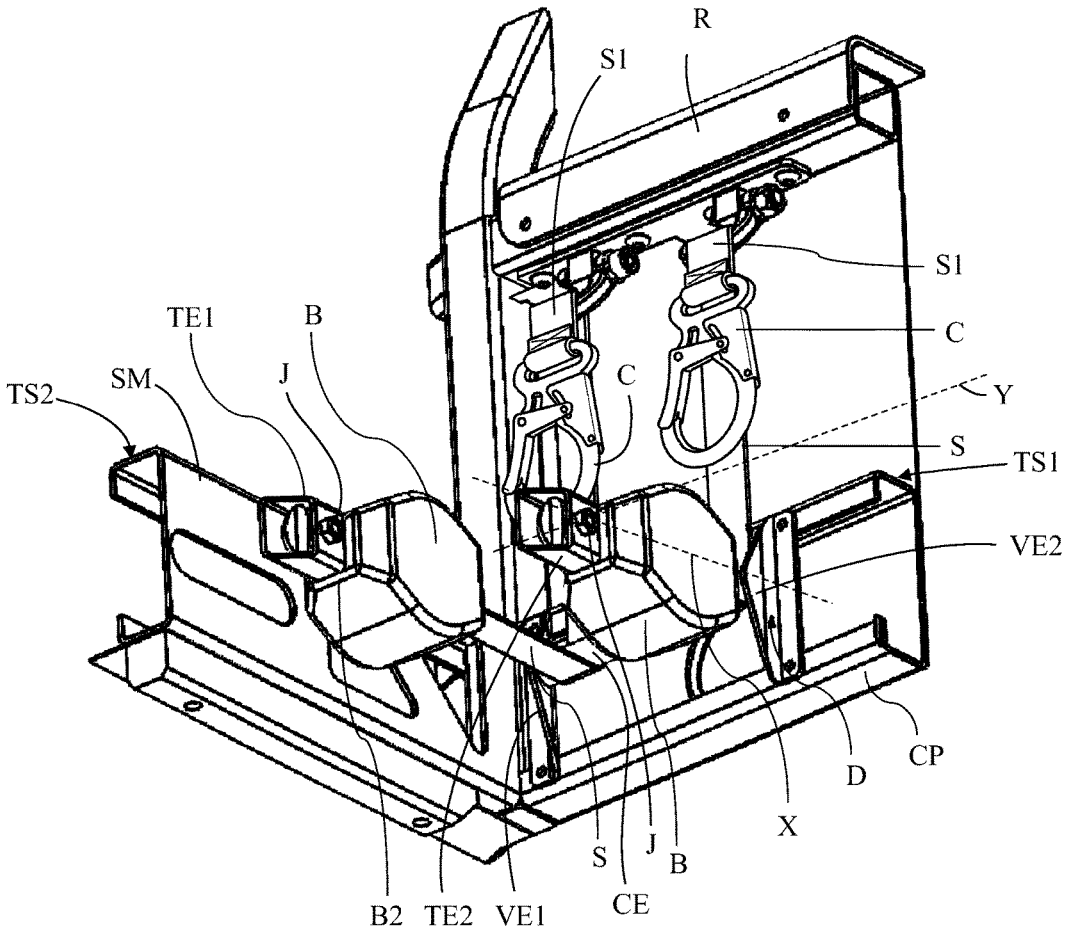
FIG. 2 shows another perspective view of the subject of FIG. 1, FIGS. 3 and 4 show different perspective view of another preferred embodiment of the invention

FIGS. 1 and 2 show a portion of a rescue cage frame F where two retractable fall arresters FA are supported by the frame F.

Each retractable fall arrester FA has a body B and defines its own developing axis X indicating two opposite first and second sides B1 and B2.

A safety belt S slides out from the first side B1 of each body B.

According to the present invention, a deflecting means D is arranged in front of the first side B1 of each body B, with a positive distance/clearance from the first side B1, suitable to absorb any pulling strengths deflected from said developing axis X, so as the retractable fall arrester FA is subjected only to a pure pulling strength and the second side B2 is supported by the cage frame F through the joint J.

Advantageously, the body B is affixed to a fixed point—the frame F—through the joint J, so as during a sudden extraction of the safety belt S, eventual oscillations of the safety belt S sliding on the deflecting means D do not negatively affect the body B, that can freely swing over the joint J accordingly.

The safety belt S preferably is in the form of a flat webbing, therefore, its pairing, namely its partial tangent winding, with a longilineal and tubular element is advantageous. In other words, the deflecting means D opposite to the side where the safety belt S slides, can consist of one or a couple of longitudinal elements, preferably tubular, such as a central element CE. Therefore, according an implementation, the deflecting means D can be defined by one or a couple of parallel tubular elements, such as the central element CE, defining a longilineal slit through which the safety belt S slides.

Preferably, the joint J comprises a ball joint or a single hinge, which has a rotation axis Y parallel to the tubular element(s) defining, in part, the deflecting means D preferably perpendicular with the development axis X. In addition, the joint J could comprise an additional hinge (not shown) having a rotation axis coincident or parallel with the development axis X of the body B. Due to this last possibility, according to the positioning of the deflecting means D and the shape of the safety belt S, the body B can better orient itself in order to be subjected only to pure pulling forces.

It should be clear that FIGS. 1 and 2 show the terminals TE1 and TE2 of a square tubular elements, cut obliquely for a better comprehension of the figures, however such terminals are fixed with the frame F and represent the fixed part of the joint J to which the body B is connected.

Following the example shown in the FIGS. 1 and 2, the safety belt S passes within a loop L, preferably supported by the railing R of the rescue cage, preferably a few centimeters vertically over the deflecting means D, ready to be pulled and connected to his/her own safety harness in any dangerous condition.

Preferably, the carabiner or hook C affixed at the free and accessible end 51 of the safety belt S interferes with the loop L in order to prevent the complete winding of the safety belt S, by constantly maintaining the body B under traction. Alternatively a separate and thick element is affixed on said free end of the safety belt S in order to interfere with the loop L by maintaining the carabiner hung up to the loop L.

According to the FIGS. 1 and 2, the floor FL includes a crosspiece CP and a structural member SM disposed perpendicular to the crosspiece CP. The body B is arranged under the floor FL of the cage frame F. The crosspiece CP has a top surface TS1 and the structural member SM has a top surface TS2. The top surfaces TS1 and TS2 define a floor plane with the body B disposed under the floor plane. Therefore, the safety belt S is subject to a first deviation impressed by the deflecting means D and a second deviation impressed by the loop L. Therefore, the safety belt S runs following the shape of the cage frame F: firstly from within the floor FL, then vertically up a wall till the loop L.

According to the comparison of FIGS. 1 and 2, it is possible to appreciate the shape of the deflecting means D, defined by a sort of H, where the vertical and parallel elements VE1 and VE2 of the H are affixed through screws to the box-shaped crosspiece CP, parallel with the floor FL of the cage frame F, and the central element CE of the H is a tubular element.

Furthermore, according to a preferred embodiment of the invention, the bodies B, are connected in such a way they are spaced apart one from the other in terms of distance/clearance from the deflecting means D in order to assume a more compact configuration, despite of their lateral sizes.

Figure 3:
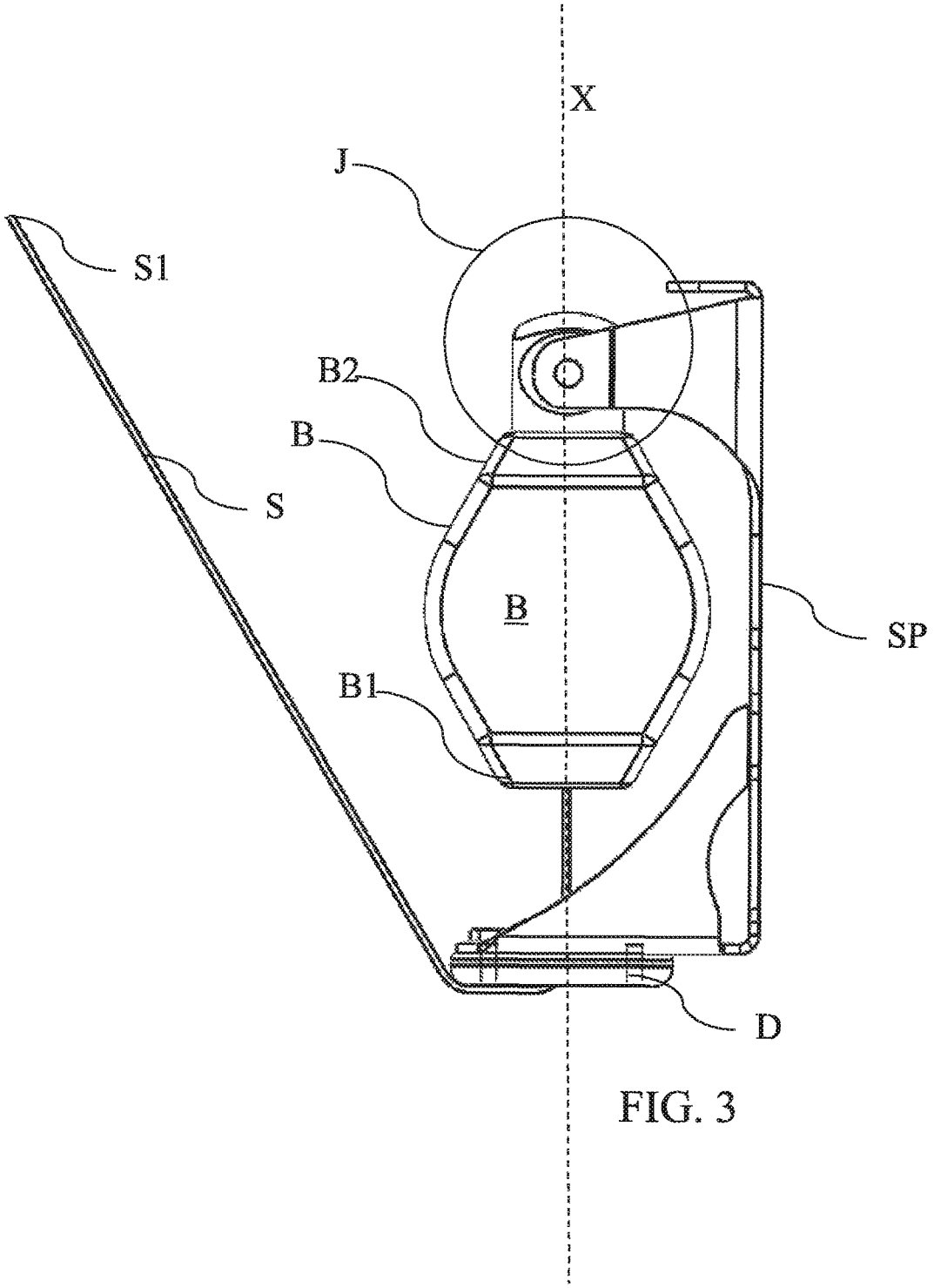
Figure 4:
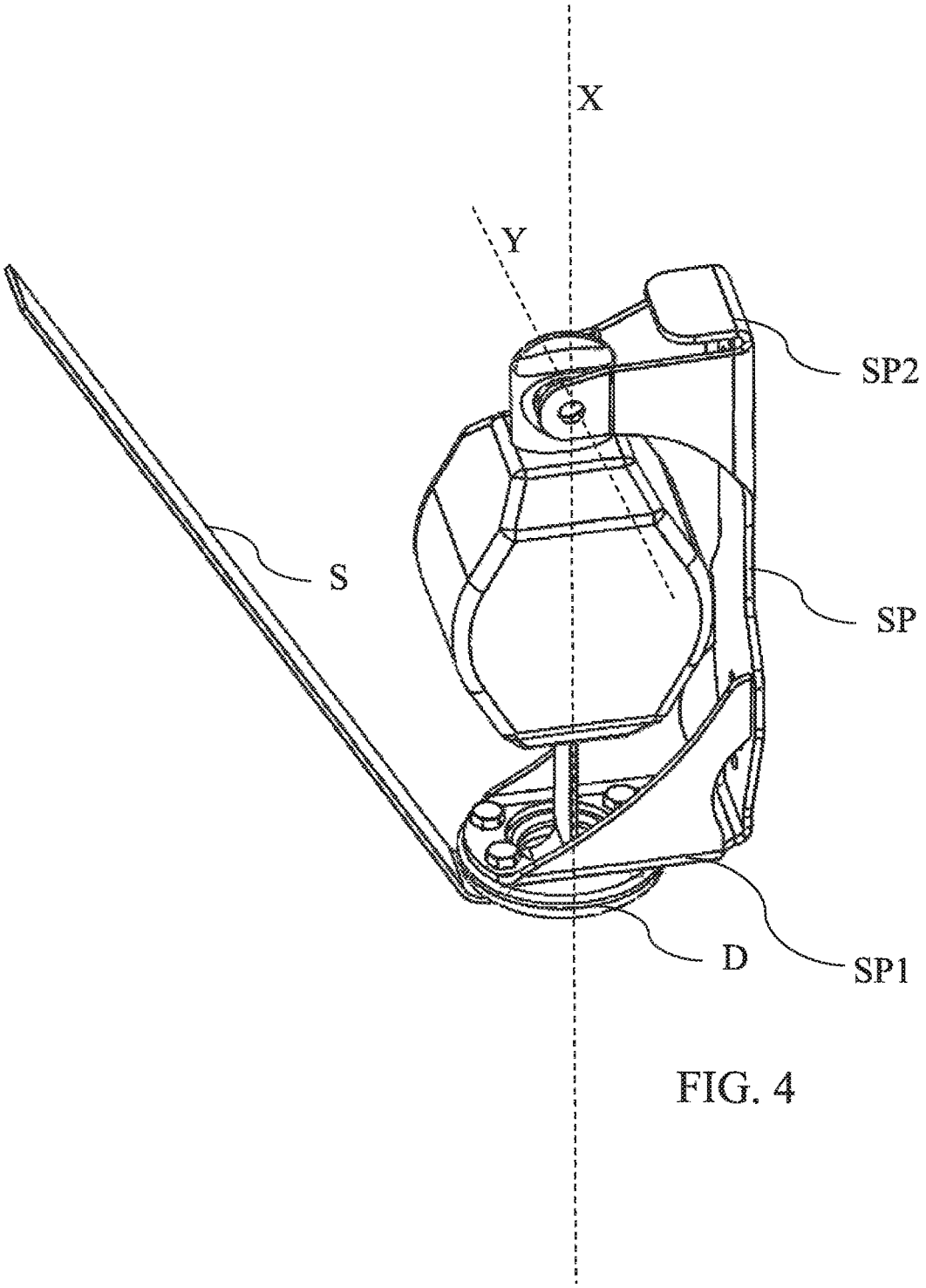

According to another preferred embodiment of the invention disclosed through the FIGS. 3-5, the relative positions of the joint J, the body B and the deflecting means D is maintained by an auxiliary component here below called support element SP. It comprises two opposite ends SP1 and SP2, the first end SP1 is configured to support or define deflecting means D while the second end SP2 is configured to support or define a joint J connected with the second side B2 of the body B.

Preferably such support element SP is made of a T-shaped flat metallic component having its central portion parallel with the developing axis X of the body B. The two arms of the T, at the SP2 end, are 90° folded with respect to the central portion of the T, in order to face each other. Such arms are provided with a connecting pin in order to define the fulcrum of a hinge according to the Y axis, perpendicular with the development axis X. The support element has, at SP1, an end folded of 90° with respect to the development of its central portion, to support the deflecting means D. The deflecting means D, according to this embodiment, consist of a ring annularly supported in order to have its rotation axis coincident with the development axis X of the body B. Eventual strengthen arms laterally and obliquely connect the folded portion of the end SP1 with the remaining central portion of the T.

Thanks to this embodiment, the support element SP can be connected to a wall of a cage or to the tip of an aerial ladder, by autonomously maintaining the right relative positioning and clearance of the deflecting means D and of the body B of the retractable fall arrester FA.

Figure 5:
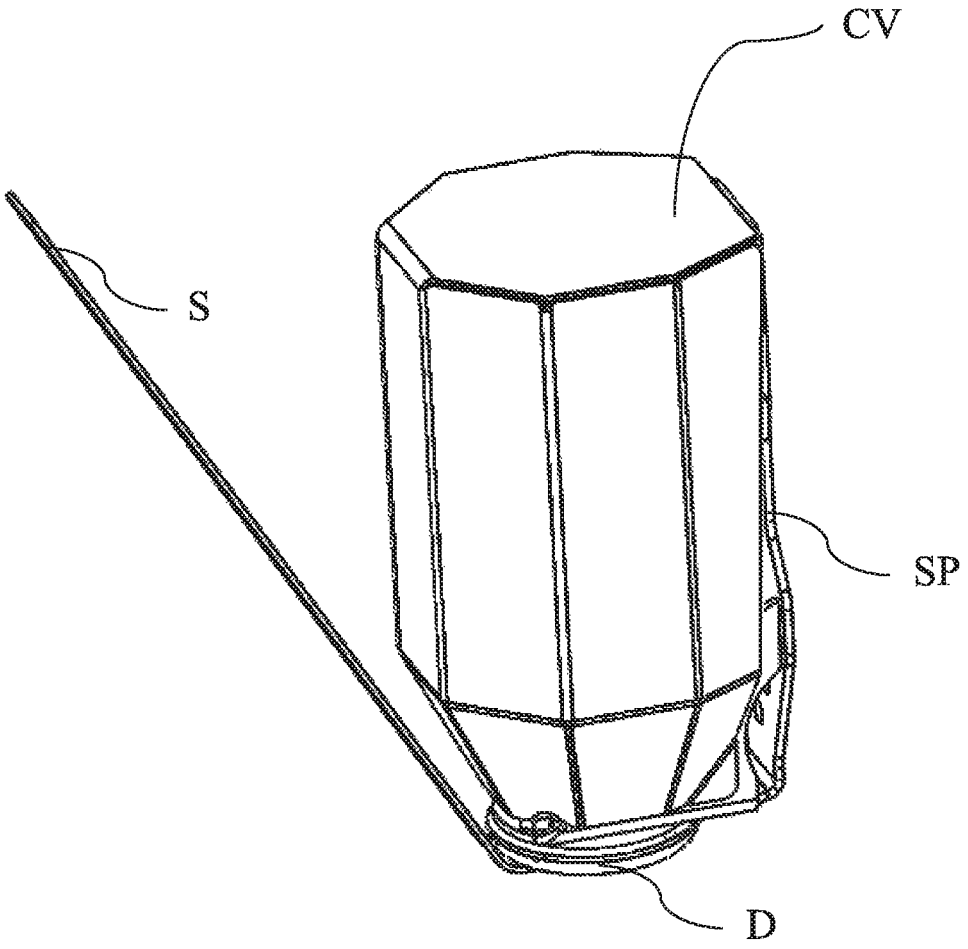
FIG. 5 shows a cover that can be associated with the embodiment shown in the FIGS. 3 and 4.

FIG. 5 shows an embodiment where a cover CV, appearing as bottle, winds up the device so that the mouth of the bottle CV coincides with the deflecting means D, by leaving enough clearance for the body B of the retractable fall arrester FA to orientate itself in order to be subjected to pure pulling forces, despite of the direction in which the safety belt S is pulled by the operator during his operations.

According to the FIGS. 3-6, the device is self protected by the environment and has its internal clearance to permit the body B to self orientate, while, according to the first embodiment disclosed with reference to FIGS. 1 and 2, the mounting of the fall arrester FA in the ground structure of a rescue cage frame F together with the deflecting means D should be carried out by assuring the above clearances. However, such embodiment exploits the protection given by the coverage of the ground structure, namely without an additional cover. Therefore, according to such embodiment of the FIGS. 1 and 2, less weight is needed to protect the device from the environment agents.

Many changes, modifications, variations and other uses and applications of the subject invention will become apparent to those skilled in the art after considering the specification and the accompanying drawings which disclose preferred embodiments thereof.

It should be understood that all the single features and/or embodiments can be combined between each other. In addition, the features disclosed in the prior art background are introduced only in order to better understand the invention and not as a declaration about the existence of known prior art. Therefore, also the features described in the prior art background can be considered in combination with those mentioned in each embodiment of the detailed description.

Further implementation details will not be described, as the man skilled in the art is able to carry out the invention starting from the teaching of the above description.

What is claimed is:

1. A rescue cage of an aerial ladder, configured for use with firefighting vehicles, the rescue cage comprising:

a frame having a floor defining a perimeter and a railing attached to the floor around the perimeter, the floor having a crosspiece, a retractable fall arrester having a body with a first end and a second end opposite to said first end, wherein said first end includes an opening through which a self-retractable safety belt slides, the retractable fall arrester being disposed within the floor of the rescue cage; and a deflecting element arranged in front of said first end of the body and spaced apart from said first end of the body, the deflecting element including a first end and a second end, said deflecting element being connected to a first vertical support on the first end, and a second vertical support on the second end, so that the first and second vertical supports and the deflecting element form an H-shape, the vertical supports being attached to the crosspiece of the floor.

2. The cage according to claim 1, further comprising a railing beam and the safety belt passes within a loop supported by the railing beam, the loop is located vertically over the deflecting element, so as a free end of the safety belt is ready to be pulled and connected to a safety harness of an operator.

3. The cage according to claim 1, wherein said safety belt has a free and accessible end fixedly connected with a carabiner or a hook.

4. The cage according to claim 3, wherein said carabiner or hook interferes with a loop in order to prevent complete winding of the safety belt.

5. A vehicle provided with an aerial ladder and a rescue cage connected with a tip of said aerial ladder, wherein the cage is according to claim 1.

6. A rescue cage of an aerial ladder configured for use with firefighting vehicles, the rescue cage comprising:

a frame having a floor;

a retractable fall arrester having a self-retractable safety belt and body with a first end and a second end opposite to said first end, the first end includes an opening, the self-retractable safety belt slides through the opening, the retractable fall arrester being disposed within the floor of the rescue cage; and a deflecting element arranged in front of the first end of the body and spaced apart from the first end of the body, the self-retractable safety belt extending from the opening about the deflecting element and extending away from the floor.

7. The rescue cage according to claim 6 further includes a railing beam and a loop attached to the railing beam, the safety belt extending from adjacent the deflecting element to and through the loop with a free end of the safety belt beings ready to be pulled and connected to a safety harness of an operator.

* * * * *